US009242128B2

(12) United States Patent
Macy

(10) Patent No.: US 9,242,128 B2
(45) Date of Patent: Jan. 26, 2016

(54) FALL ARRESTER

(75) Inventor: Philip J. Macy, Clarkston, MI (US)

(73) Assignee: Key Safety Systems, Inc, Sterling Heights, MI (US)

( * ) Notice: Subject to any disclaimer, the term of this patent is extended or adjusted under 35 U.S.C. 154(b) by 0 days.

(21) Appl. No.: 14/126,940

(22) PCT Filed: Jun. 27, 2012

(86) PCT No.: PCT/US2012/044301

§ 371 (c)(1),
(2), (4) Date: Dec. 17, 2013

(87) PCT Pub. No.: WO2013/003402

PCT Pub. Date: Jan. 3, 2013

(65) Prior Publication Data

US 2014/0138186 A1 May 22, 2014

Related U.S. Application Data

(60) Provisional application No. 61/502,761, filed on Jun. 29, 2011.

(51) Int. Cl.

| | |
|---|---|
| ***A62B 35/04*** | (2006.01) |
| ***A62B 35/00*** | (2006.01) |
| *A62B 1/08* | (2006.01) |

(52) U.S. Cl.

CPC ..... *A62B 35/0093* (2013.01); *A62B 35/04* (2013.01); *A62B 1/08* (2013.01)

(58) Field of Classification Search

CPC ..... A63B 35/0093; A06B 35/00932
See application file for complete search history.

(56) References Cited

U.S. PATENT DOCUMENTS

| | | | | |
|---|---|---|---|---|
| 4,877,110 | A * | 10/1989 | Wolner | 182/232 |
| 6,383,308 | B1 * | 5/2002 | Nishizawa et al. | 148/320 |
| 6,511,008 | B1 * | 1/2003 | Oda et al. | 242/376.1 |
| 8,181,744 | B2 * | 5/2012 | Parker et al. | 182/232 |
| 8,800,719 | B2 * | 8/2014 | Auston et al. | 182/234 |
| 2009/0178887 | A1 * | 7/2009 | Reeves et al. | 182/239 |
| 2010/0252366 | A1 * | 10/2010 | Jones et al. | 182/232 |
| 2011/0084157 | A1 | 4/2011 | Meillet | |

FOREIGN PATENT DOCUMENTS

| | | | |
|---|---|---|---|
| EP | 1034814 | A1 | 9/2000 |
| WO | 2007112008 | A2 | 10/2007 |
| WO | 2008008225 | A2 | 1/2008 |

* cited by examiner

*Primary Examiner* — Alvin Chin-Shue
(74) *Attorney, Agent, or Firm* — Markell Seitzman

(57) ABSTRACT

A fall arrester (100) for reducing injuries of a user (108) thereon when falling comprising a rotatable spool (314) with webbing (200) wound thereon, the webbing (200) being protracted from and retracted back upon the spool (314), a torsion bar (310) operationally connected to the webbing (200) through the spool (314) to generate a generally constant reaction force on the spool (314) as the torsion and bar and spool (314) rotate to absorb kinetic energy of the fall; the fall arrester (100) according to claim 1 further including a counting mechanism (500) to maintain a reserve amount of webbing (200) on the spool (314) to enable the torsion bar (310) to twist through its operational range without encountering an end-of-webbing condition.

7 Claims, 8 Drawing Sheets

4b

FALL ARRESTER

BACKGROUND AND SUMMARY OF THE INVENTION

A fall arrester or fall arresting device is typically included in a harness worn by an individual working at elevated heights; the fall arrester reduces injuries that might occur if the worker falls from his or her work station.

More specifically, the present invention includes a protection device or fall arrester for a user thereof for arresting a fall or potential fall of a user from an elevated location, comprising: a frame; a spool rotationally supported on the frame, a length of flexible connecting member; including one of a length of webbing or string or wire; having one end secured to the spool and a second end adapted to be linked to a connector including a hook for securing the second end to a weight supporting member of a nearby structure. The connecting member is capable of being pulled from the spool and capable of being rewound upon the spool by a rewind spring during an unlocked mode of operation. The fall arrester also includes a torsion bar having a first end secured to one side of the spool and rotatable with the spool and a second end connected to a first lock wheel capable of selectively being locked from rotation when the device has entered into a locked mode of operation. If the user falls, the torsion bar twists through a given number of turns after the locked mode is entered and the connector member and spool are loaded. The fall arrester includes a web counting mechanism which is active during the unlock mode of operation and causes the fall arrester to enter into the locked mode of operation when a determinable length of the flexible connecting member has been protracted from the spool or alternately remains on the spool. This function insures that there will be a sufficient amount of the connector member (webbing or lanyard) on the spool to enable the torsion bar to thereafter rotate through the given number of revolutions if the user subsequently falls. The fall arrester, in its preferred embodiment, includes an acceleration sensor able to initiate the fall arrester entering into a locked mode of operation when the connecting member is being protracted at a first dynamic level independent of the length of connecting member that has been protracted from the spool.

DETAILED DESCRIPTION OF THE DRAWINGS

Figure 1:
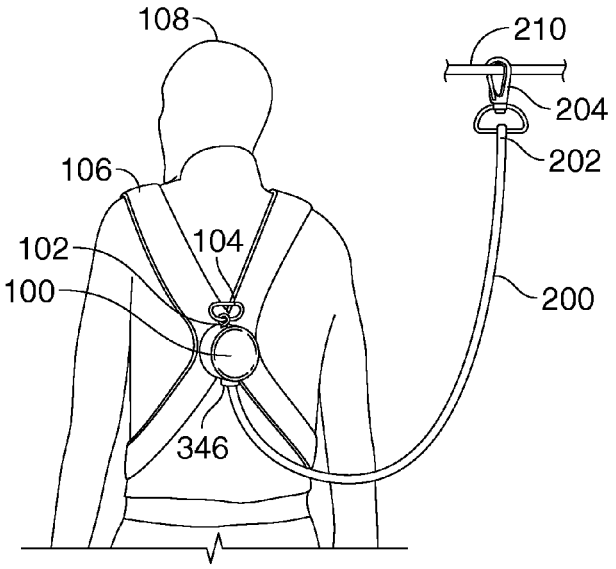
FIG. 1 diagrammatically shows the fall arrester of the present invention as part of a harness worn by a user or worker.

FIG. 1 shows the typical environment in which the fall arrester 100 of the present invention is used. As can be seen, the fall arrester includes a fastener 102 that is connected to a shackle 104 that is incorporated within a harness 106 worn by a user or worker 108. The means by which the fall arrester 100 is secured or attached to the harness is incidental to the present invention. Extending from the fall arrester is a length of lanyard or webbing 200 with an end 202 of the webbing connected to a fastener such as a snap hook 204, which enables the user/worker to secure the snap hook to some element in an adjacent structure such as a pipe, hook or other complementary fastener or complementary feature in the structure. Preferably the worker 108 will secure the snap hook to a structure at a location higher than the height of the fall arrester.

In general it can be seen the fall arrester functions to tether the worker to the adjacent structure 210. The present fall arrester 100 functions basically as a spring-loaded tether, in an unlocked mode of operation, in which the lanyard or webbing or tether can be extracted from a housing of the fall arrester and refracted back into the housing. In a second mode of operation the fall arrester monitors the amount or the connector member (lanyard, webbing) that has been extracted and then at a determinable length enters into the locked mode of operation. In a mode of operation related to the second mode of operation, the fall arrester of the present invention returns to its unlocked mode of operation after a minute amount of connector member (lanyard, webbing) has been retracted back into the housing. The present fall arrester will also enter its locked mode of operation, characterized by an emergency locking mode, activated when the user is falling at a predetermined acceleration. Early fall arresters did not include any energy absorbing mechanism and when the fall arrester entered into the locked mode of operation the connector member (lanyard, webbing) became taut and the falling user experienced a significant jerk-load which could further injure the user. Such energy absorbing mechanisms included an elaborate section of folded-over lanyard (webbing) which tore as it was loaded. The present fall arrester incorporates an energy absorbing mode of operation using a torsion bar to reduce reactive forces acting upon the user as his fall is stopped by operation of the fall arrester.

Figure 2:
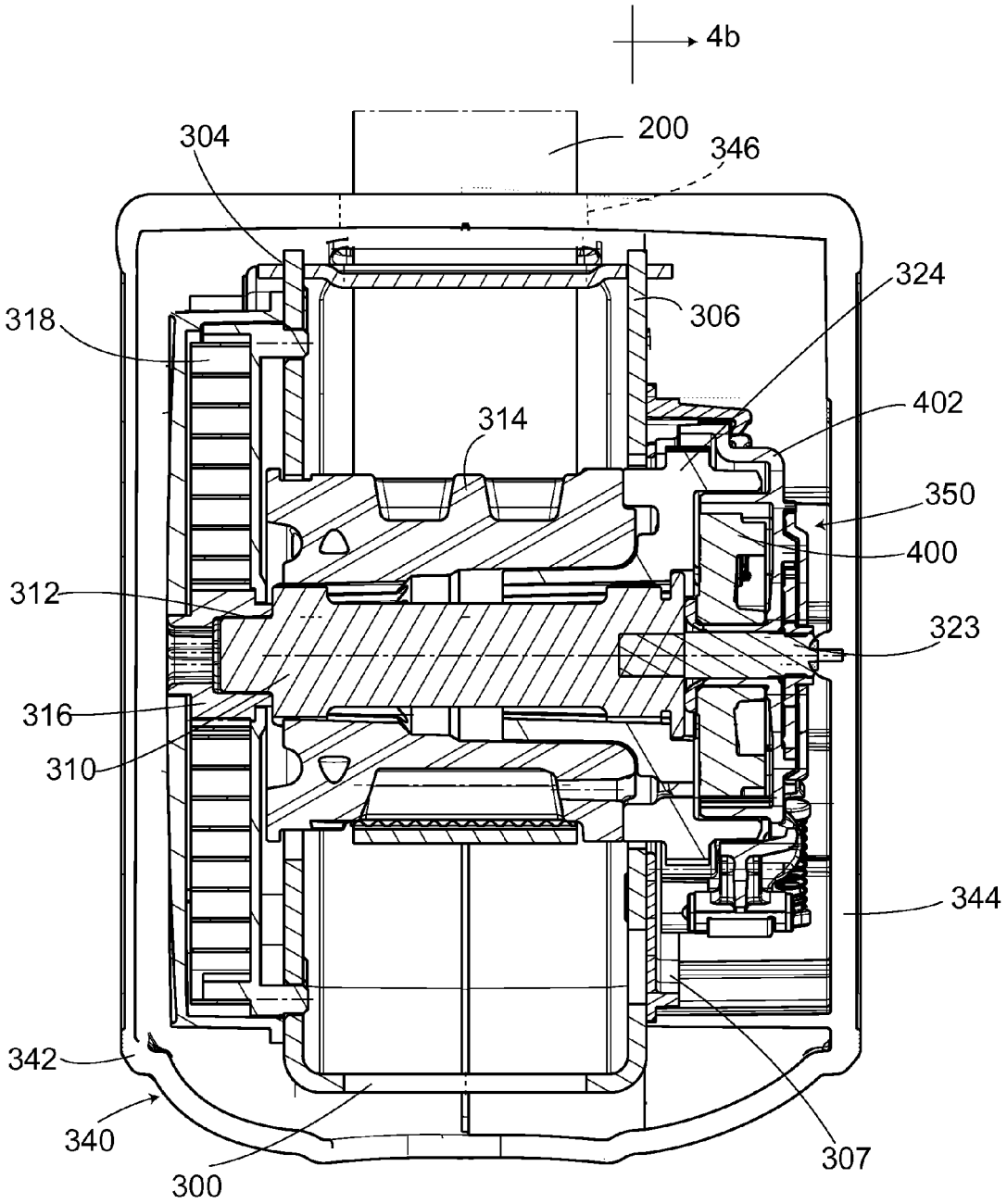
FIG. 2 is a cross-sectional view of the fall arrester of the present invention.
Figure 3:
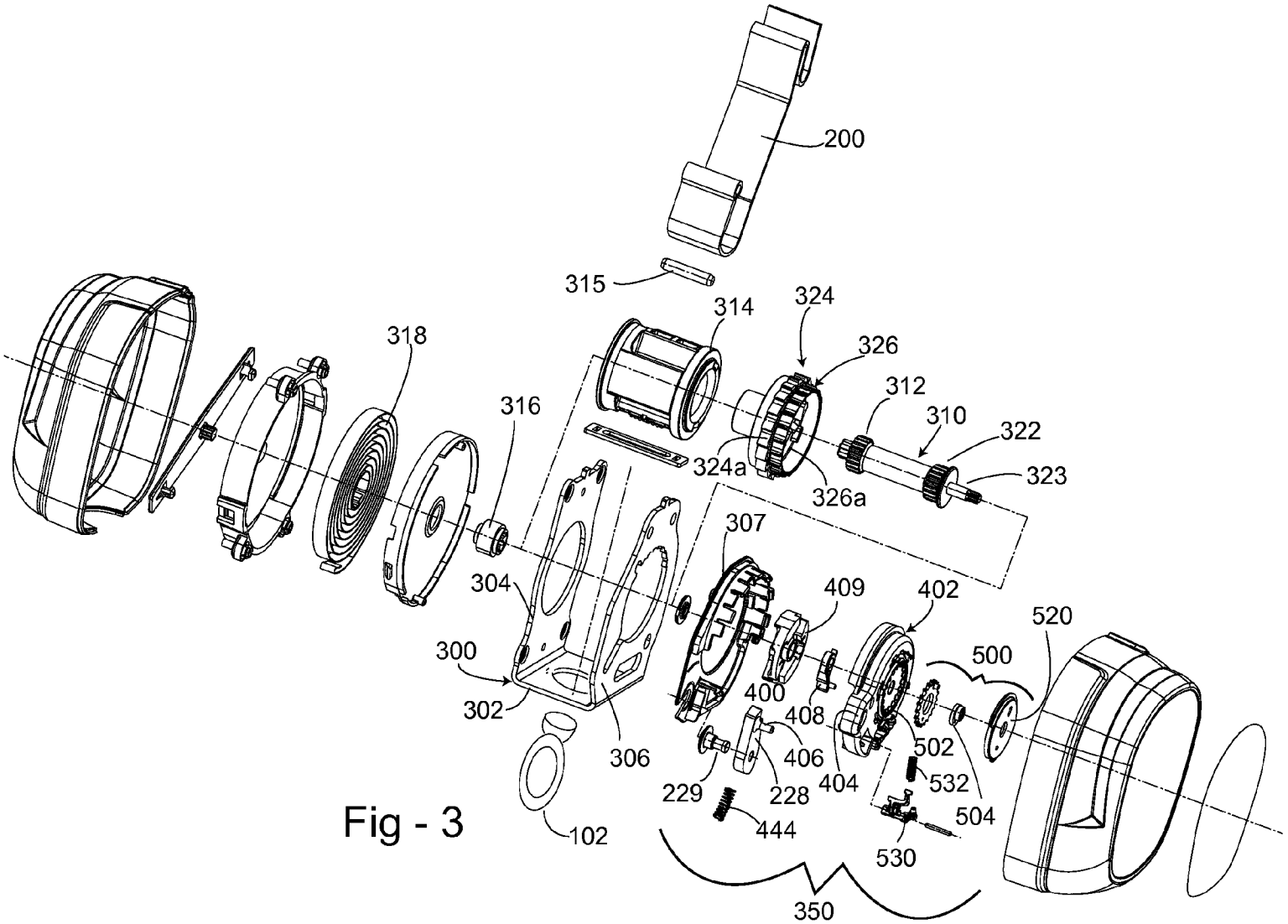
FIG. 3 is an exploded view of the fall arrester.

Reference is made to FIGS. 2 and 3. FIG. 2 is a cross sectional view of fall arrester 100 and FIG. 3 is an exploded view. The fall arrester comprises a U-shaped frame 300 with a center portion 302 and two opposing sides 304 and 306. The center portion 302 of the frame 300 supports connector/fastener 102 which can be joined to a shackle 104, shown in FIG. 1, which in turn, as mentioned, is secured to the harness 106. The frame rotationally supports a torsion bar 310; the torsion bar at end 312 is joined to a winding reel or spool 314. The lanyard or webbing 200 is wound about the spool; the webbing can be joined to the spool by a pin 315. End 312 further includes a spring arbor 316 which is joined to a rewind spring 318 which is protected by a cover and covering plates (unnumbered). When the lanyard or webbing 200 is pulled or moved out of the fall arrester 100 the rewind force of spring 318 increases to retract the webbing 200 back into the fall arrester. Torsion bar 310 includes another end 322. A first and second lock wheel 324 and 326 are rotationally linked to the torsion bar proximate end 322 and rotate therewith. The second lock wheel is also referred to as a pilot wheel. The torsion bar includes an extending end 323, which in the illustrated embodiment is formed as a pin pressed into the torsion bar. The torsion bar functions as a center axle of the spool. Positioned alongside sides 306 of the frame is a plurality of control mechanisms 350 which are diagrammatically shown in FIG. 4 Fall arrester 100 further includes a lock pawl 228 which is selectively moved into contact with one of the teeth 324*a* of lock wheel 324 by operation of one or more of the control mechanisms 350 as also shown in FIG. 4*a*. The lock pawl rotates about a pin 229 which is secured to frame side 306. Lock wheel includes a plurality of teeth 326*a*. The various internal mechanisms of the fall arrester 100 are protected by a two-sided cover 340 secured to the frame and formed with a mating first side 342 and a second side 344. Portions the cover 340 generally opposite connector 102 can be formed into an e slot 346, also shown in FIG. 1, which guides the trajectory of the webbing as it is rewound on the spool 314.

Reference is again made to FIG. 2 as well as to FIG. 3, which is an exploded view of fall arrester 100. The control mechanisms 350 diagrammatically shown in FIG. 2 include an inertial sensor 400 of the often used in seat belt retractors and referred to in the art is a web sensor which is positioned about an extending portion 323 of the torsion bar and which rotates therewith. Enclosing the inertial sensor 400 is a lock cup 4 which includes an activation slot 404, also shown in FIG. 4, into which link pin 406 is received. Link pin 406 is an extension of the lock pawl 228 which includes one or more teeth 231. FIG. 4*b* is a section view through section 4*b*-4*b* of FIG. 4 and shows a bushing plate 307 which is adjacent side 306, the inertia sensor 400 and sensor pawl 408, having teeth 411 which engage teeth 410 on the interior of the lock cup. Pawl 408 is attached to lock wheel 324, and is biased out of engagement with the lock cup teeth by spring 409. During situations when the rotational acceleration of the spool exceeds a predetermined value, the inertial sensor 400, which rotates with the torsion bar at end 323, causes the sensor pawl 408 to engage the lock cup 402, coupling the lock cup to the rotating torsion bar. Rotation (the lock cup changes the orientation of slot 404, which in turn moves the pin 406 toward teeth 324*a*, which moves a lock pawl 228 into locking engagement with one of the teeth 324*a*, thereby causing the fall arrester lock. Movement of the lock cup in an opposite direction removes the lock pawl from the lock teeth. The lock cup 402 is rotationally biased by spring 444, which rotates the lock cup in a direction which tends to move the log pawl 228 out of engagement with the lock teeth 324*a*.

Figure 5:
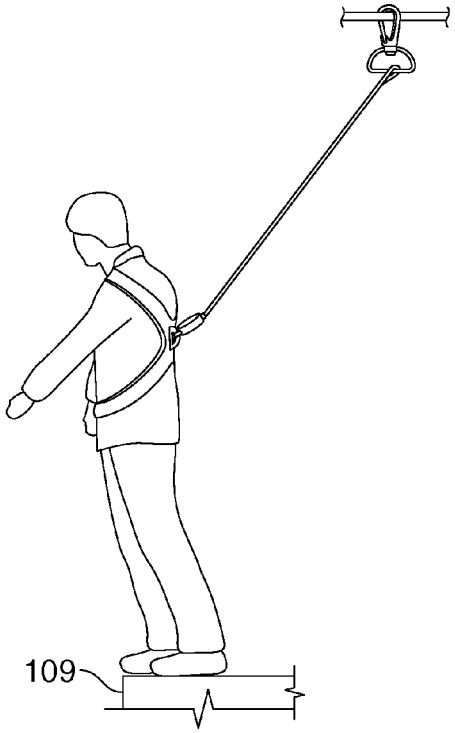
FIG. 5 diagrammatically illustrates a situation in which the user of the fall arrester is falling or in an impending fall.

Reference is briefly made to FIG. 5 which shows the user 108 located on structure 109, such as a building or elevated crane. If the user were to fall or is in an impending fall, the rotation of the spool/torsion bar would quickly exceed a certain predetermined level of acceleration, which is reacted to by the inertia sensor 400 and the fall arrester enters its locked mode of operation. During this mode of operation, with the torsion bar 310 locked in view of the engagement of lock pawl 228 with lock wheel 324 and the engagement of lock wheel 324 with the coupling end 322 of torsion bar 310, the right-hand portion of torsion bar 310, as illustrated in FIG. 2, can no longer rotate. However, the forces created as the user falls will be transferred to the webbing or lanyard 200 and then to the spool 314. These forces will be in a direction tending to rotate the spool and are then transferred to the torsion bar in view of the coupling end 312, thereby causing the torsion bar to twist. As the torsion bar twists it generates a restraining force tending to slow the fall of the user. In this way the torsion bar absorbs the energy of the fall.

The fall arrester might inadvertently enter into the locked mode of operation if the user moves for example horizontally, from one position to another at an acceleration that would cause the above locking of the fall arrester. If the situation happens, the user would simply relieve any tension on the webbing/lanyard to enable the fall arrester to retract a minute amount of webbing under the influence of the return spring, which would unlock the fall arrester from this mode of operation.

Figure 6:
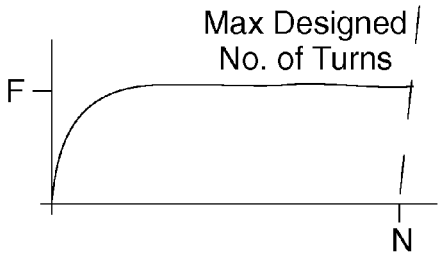
FIG. 6 diagrammatically illustrates the energy absorbing force generated by a torsion bar included within the fall arrester.

Reference is briefly made to FIG. 6 which illustrates the force F generated by the torsion bar as the torsion bar is twisted a number of times, N, through its design range. One of the benefits of the present invention is the torsion bar is positioned within the cover of the fall arrester. Some fall arresters overlap lengths of webbing which are sewn together. During a fall, the various layers of sewn webbing break apart to absorb the energy of the fall. The advantage of the present invention is that the torsion bar generates a generally consistent absorbing force and also is not subject to environmental contamination since the torsion bar is located in the housing; in contrast the sewn layers of webbing or lanyard are not.

Reference is again made to FIGS. 2, 3, 3*a* and 4. The control mechanism 350 includes what can generally be described as a web counting mechanism 500. The purpose of the web counting mechanism 500 is to implicitly keep track of or react to the amount of webbing that has been extracted from the fall arrester and then to change the mode of operation of the fall arrester from its unlocked mode of operation, which permits the extraction and refraction of the webbing out of and into the fall arrester, to the locked mode of operation in which the fall arrester becomes locked, prohibiting further extraction of the webbing, that is until further action is taken by the user. The counting mechanism 500 is coupled to end 323 of the torsion bar and includes a first set of teeth 502 formed on the exterior surface of the lock cup 402. The fall arrester additionally includes a first drive member 504 which rotates with end 323. Member 504 is received within pinion gear 506 which includes an interior surface 507, a plurality of exterior teeth 508 and a transferred pin 509. Member 504 includes an eccentric perimeter 503, which transfers rotation of member 504 into rotation of pinion gear 506 in the opposite direction via the contact of eccentric 503 with interior surface 507. The counting mechanism includes a timing wheel 520. The timing wheel includes a center opening 522 and a slot 524, which receives the pin 509. A center portion 505 of drive member 504 extends through opening 507 in gear 506 and into opening 522 in the timing wheel 520. The rotation of the pinion gear is transmitted to the timing wheel 520 via pin 509. As the webbing is pulled out from or rewound upon spool 314, the torsion bar and spool rotate in one direction and then another. Similarly the various members of a counting mechanism 500 rotate in one direction and then another as the webbing is extracted and retracted. Arrow 525 of FIGS. 3*a* and 4 shows the direction of movement of timing wheel 520 as the webbing is extracted from the spool 314.

Figure 3A:
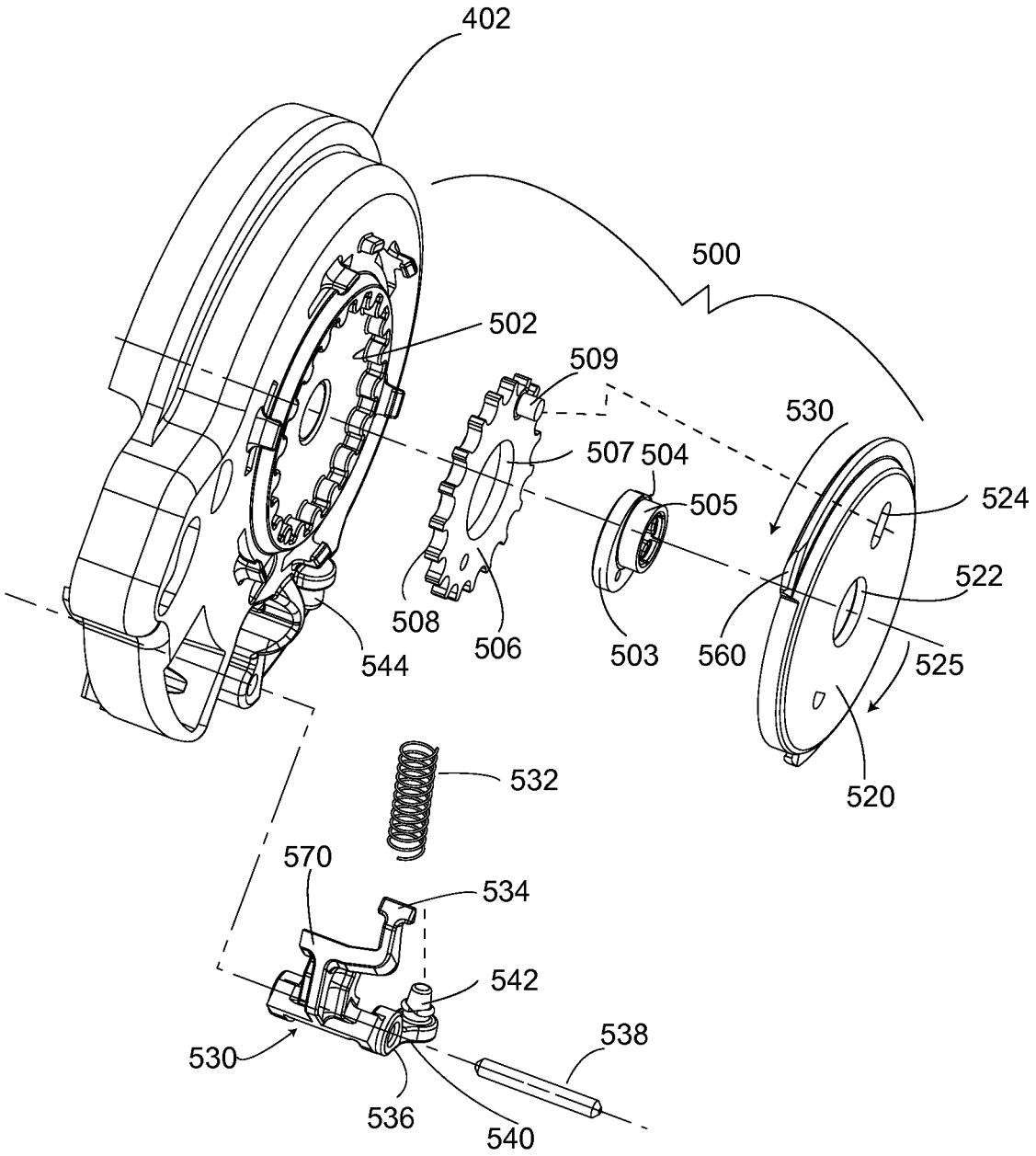
FIG. 3*a* is a further enlarged view of a portion of the fall arrester.
Figure 4:
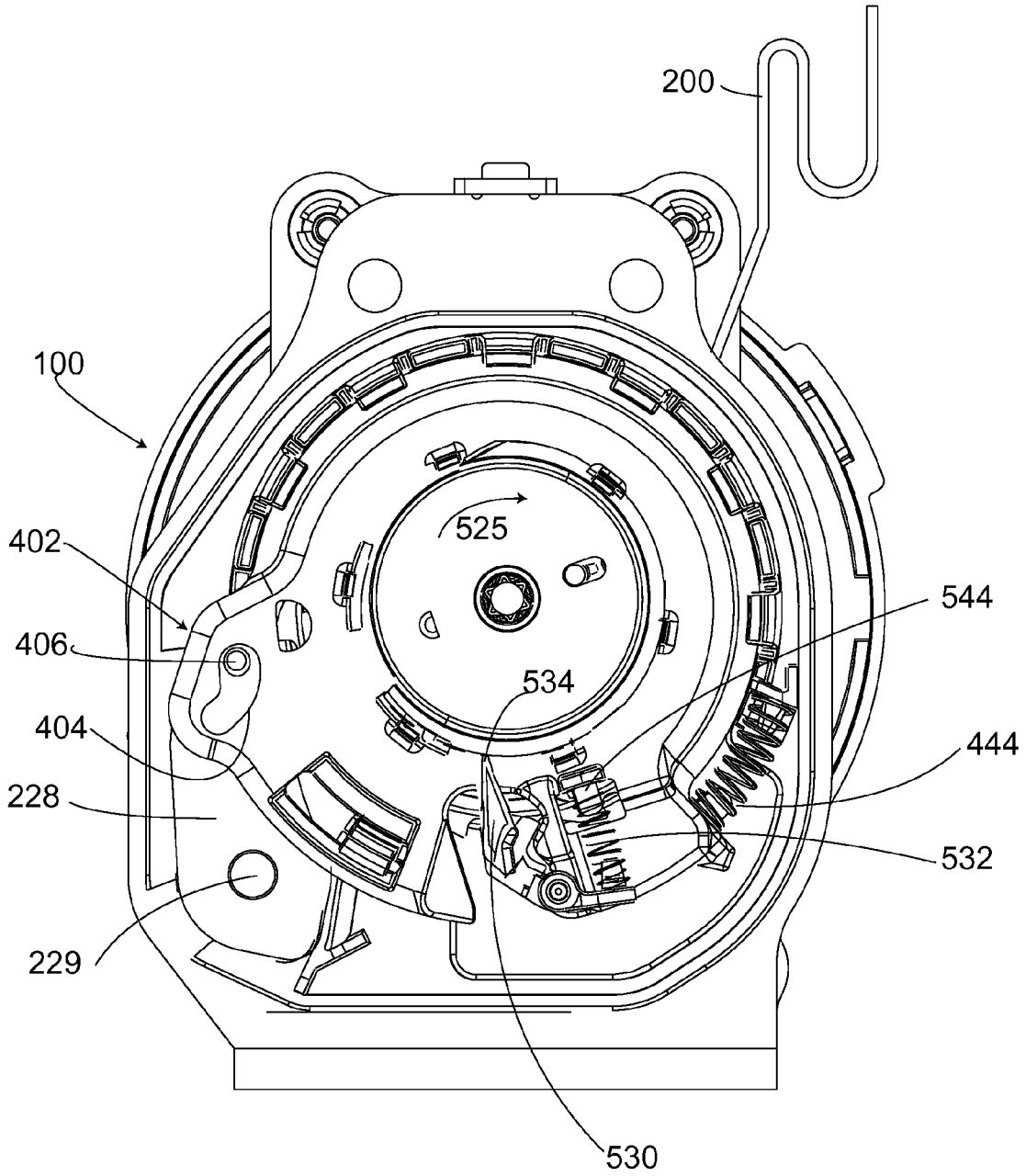
FIG. 4 is a side view of the control mechanisms included in the fall arrester, with the fall arrester in an unlocked mode of operation.
Figure 4A:
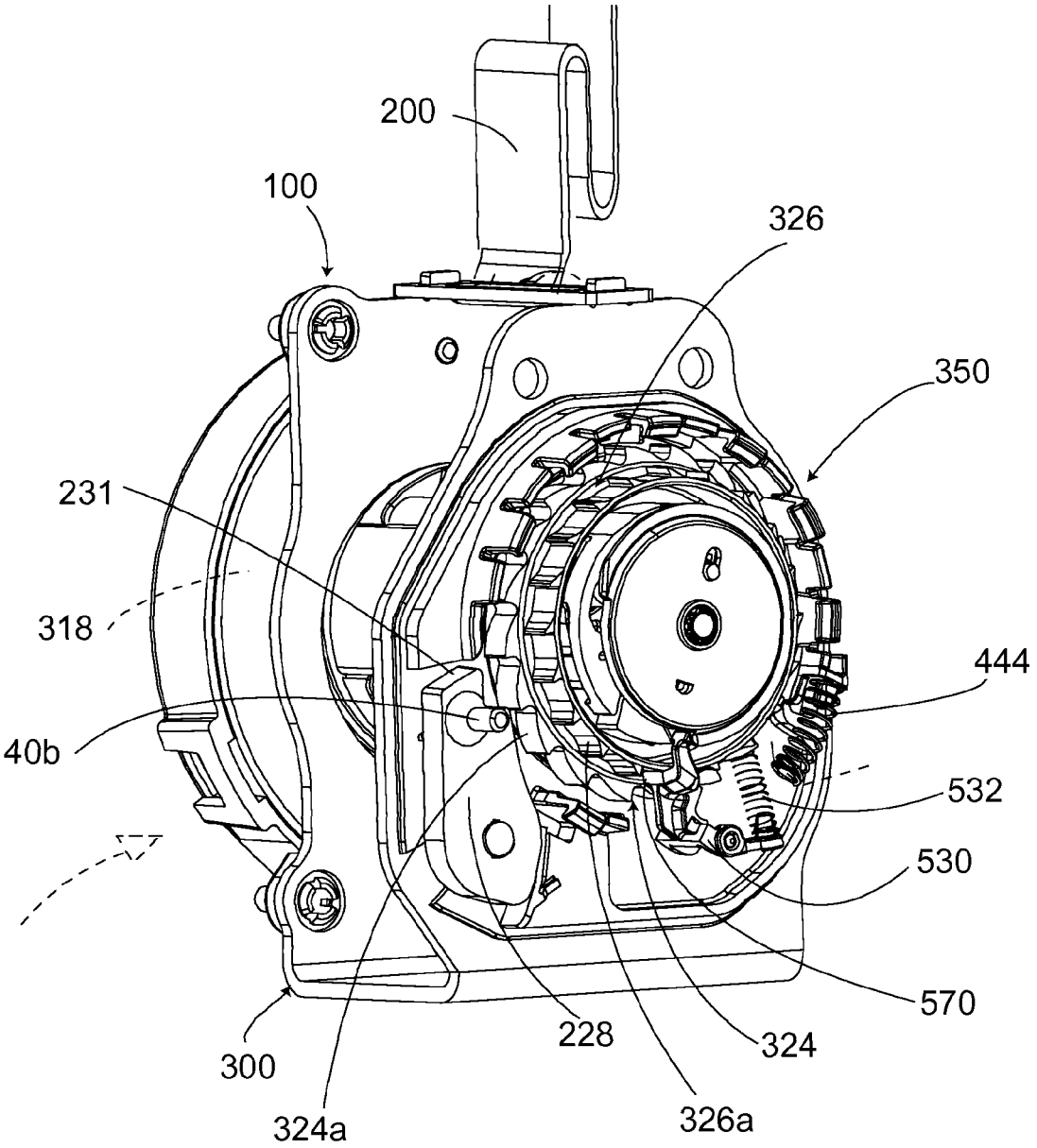
FIG. 4*a* is an orthogonal view of the locking mechanisms.
Figure 4B:
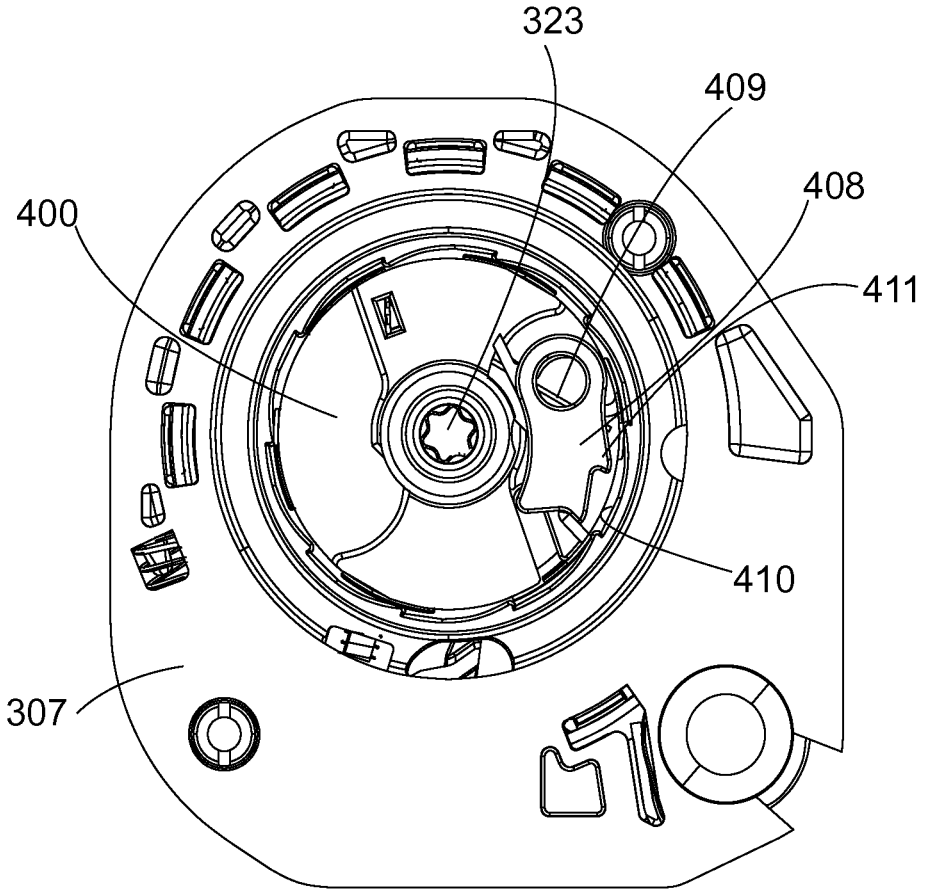
FIG. 4*b* is a cross-sectional view through section 4*b*-4*b* of FIG. 2.

The counting mechanism 350 further includes a timing pawl 530 that is spring-loaded toward an engagement position by spring 532 shown in FIGS. 3, 3*a*, 4 and others. The timing pawl 530 includes an engagement tip 534 at one end and a central bore 536 into which a pin 538 is received enabling the timing pawl to rotate. Pin 538 extends from a portion of the lock cup 402. The timing pawl 530 further includes a distal end 540 which includes a boss 542 to receive one end of bias spring 532. Another end of spring 532 is received upon a pin 544, formed as a part of a lock cup 402. As can be seen from the above figures, spring 532 exerts an outward force upon end 540, tending to rotate timing pawl 500 in a clockwise direction as illustrated in FIGS. 3 and 4.

Figure 7:
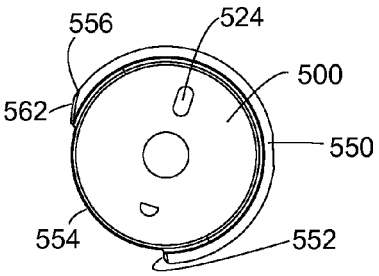
FIG. 7 is a plan view of the timing wheel.

Reference is again made to FIGS. 3, 4 and 7 and more particularly to the construction of the edge of the timing pawl 530. As can be seen in FIG. 7, edge 550 extends circumferentially about the timing pawl. The width or radius of the edge 550 is generally constant about most of the periphery of timing pawl 530. Edge 550 terminates abruptly at point 552 and the outer edge of the timing wheel transitions to a smaller radiused edge 554. Further, at about location 556, edge 550 transitions along a graduated surface 562 and transitions to the smaller radiused edge 554. The timing pawl further includes a lock tooth 570, also shown in FIG. 4*a*, designed to engage teeth 326*a*. FIG. 4 shows the lock arrester in an unlocked mode of operation with the timing pawl 530 moved outward on engagement with the larger radiused surface 550.

Figure 10:
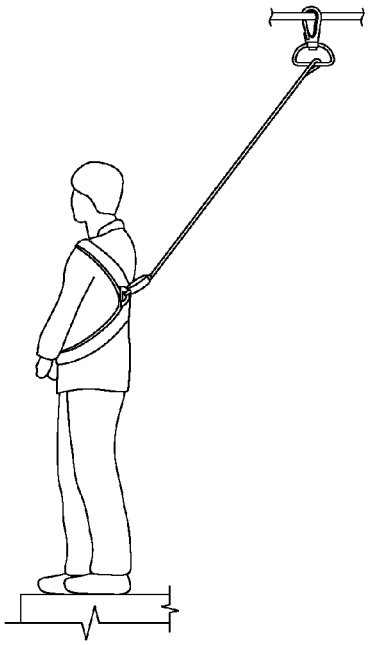
FIG. 10 diagrammatically illustrates another mode of operation of the fall arrester.
Figure 8:
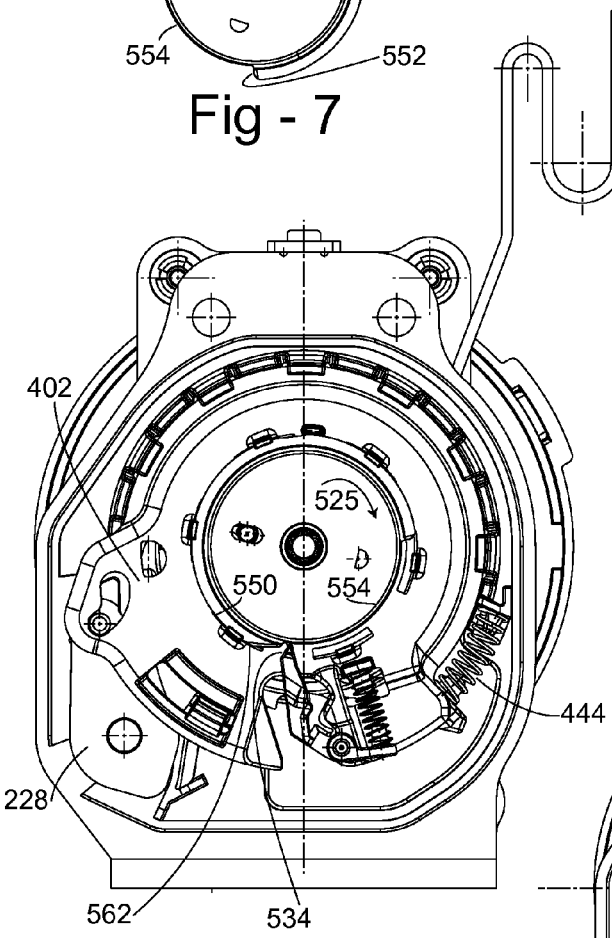
FIGS. 8 and 9 illustrate the interrelationship of the operation of a timing pawl with the timing wheel.
Figure 9:
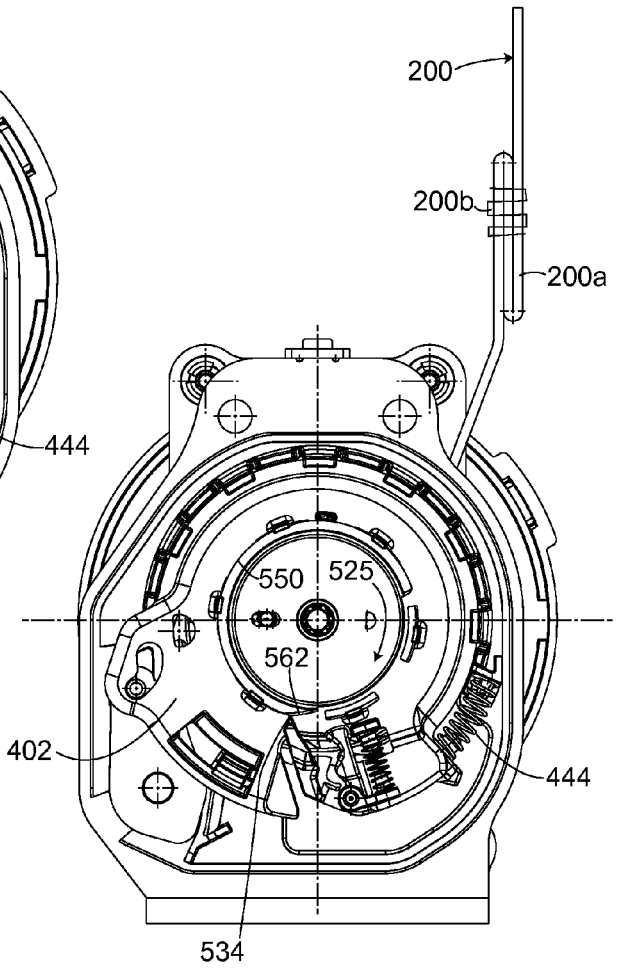

Reference is briefly made to FIGS. 8 and 9 which show the position of the timing wheel 520 as the webbing 200 is extracted from the fall arrester. As the webbing is extracted the pinion gear 506 and timing wheel 540 rotate in a clockwise direction as illustrated in FIG. 9 and by arrow 525. When the lanyard or webbing is fully refracted or not extended too much, the timing pawl rests on the larger radiused edge 550. With the timing pawl 530 upon the larger radiused edge 550 the lock tooth 570 is prevented from engaging teeth 326*a*. This represents the normal mode of operation of the fall arrester in which the webbing can freely be extracted and returned to its spool. As more and more webbing is extracted from the spool, conceptually illustrated in FIG. 10, a maximum operational length of webbing will have been reached. This condition is illustrated in FIG. 8 in which the timing wheel 520 is rotated to a position to enable the timing pawl 530 to transition along surface 562 and then to the reduced diameter edge 554. As the timing pawl moves to the reduced diameter radius surface 554, spring 532 continues to bias the lock tooth 570 into engagement with one of teeth 326*a*. At this point, the lock cup 402 is once again coupled to the rotation spool and torsion bar by virtue of the engagement of the lock tooth 570 with one of the teeth 326*a* of the pilot or lock wheel 326. The slight additional rotation of the lock cup 402 due to the tension in the lanyard/webbing once again causes a rotation of the lock pawl 228 into engagement with one of the teeth 324*a*, causing the fall arrester once again enter into a locked mode of operation. FIG. 9 shows a further embodiment of the present invention. The primary energy absorption mechanism is the torsion bar. In FIG. 9 the webbing 200 includes a series of folds 200*a* which are held together by a stitches 200*b*. During a fall, these stitches will also tear apart absorbing additional energy. The stitches can be configured to come apart prior to or after the torsion bar twists.

As can be seen the length of section 562 is chosen to be rather small to enable the user to quickly become released from the locked mode of operation and enter back into the unlocked mode of operation. If the user does not move and tension is maintain on the lanyard or webbing the fall arrester will remain in the locked mode of operation signaling to the user he cannot move any further in the current direction. If the user moves in the opposite direction about 1 inch to lessen tension on the lanyard, the spool will rotate if only slightly and the pawl 534 will ride up the transition surface 562 and rest upon the larger radiused edge and once again lift the lock tooth 570 away from lock tooth 236*a*. The various parameters of the counting mechanism 500 are chosen such that the maximum operative length of webbing that can be extracted from the fall arrester will result in a minimum length of webbing still rotated about the spool.

Returning to the operation of the above-described torsion bar in that mode of operation, after the spool/torsion bar has been locked and the user is falling, the torsion bar will rotate as it is loaded by inertial force as the user falls. As the torsion bar is loaded, it rotates a number of times through its operating range and as it does a determinable amount of webbing is extracted or pulled out from the fall arrester as the spool also rotates. The minimum length of webbing that is permitted to reside on the spool due to the web counting operation is equal to or greater than the amount of webbing that will be extracted from the fall arrester during its torsion bar mode of operation.

Many changes and modifications in the above-described embodiment of the invention can, of course, be carried out without departing from the scope thereof. Accordingly, that scope is intended to be limited only by the scope of the appended claims.

The invention claimed is:

1. A fall arrester for reducing injuries of a user when falling comprising a rotatable spool with webbing wound thereon, the webbing being protracted from and retracted back upon the spool by a rewind spring for reverse winding the webbing upon the spool, the webbing capable of being protracted from the spool and capable of being rewound upon the spool, configured to have the fall arrester function as a spring-loaded tether in an unlock mode of operation, a torsion bar operationally connected to the webbing through the spool to generate a generally constant reaction force on the spool as the torsion bar and spool rotate to absorb kinetic energy of the fall, and further includes a counting mechanism to maintain a reserve amount of webbing on the spool to enable the torsion bar to twist through its operational range without encountering an end of webbing condition, wherein the counting mechanism further is able to initiate a change in the operating mode of the fall arrester to enable the fall arrester to lock when the webbing is protracted at a first dynamic level independent of a length of webbing that has been protracted from the spool, the change to lock the fall arrester is initiated by an acceleration based sensor to sense a fall event and initiate a lock-up of the fall arrester and wherein the counting mechanism prevents further protraction of the webbing on the occurrence of a determinable length of the webbing having been protracted from the spool while leaving a sufficient amount of webbing on the spool to enable the torsion bar to thereafter rotate through a given number of revolutions.

2. The fall arrester of claim 1 wherein the torsion bar has a first end secured to one side of the spool and movable with the spool and a second end connected to a first lock wheel capable of being locked from rotation when the device is in a locked mode of operation, the torsion bar capable of being twisted through a given number of turns after the locked mode is entered and the webbing and spool are loaded.

3. The fall arrester of claim 1 wherein the counting mechanism further is able to initiate a change in the operating mode of the fall arrester to enable the fall arrester to lock when the webbing is protracted at a first dynamic level independent of the length of webbing that has been protracted from the spool.

4. The fall arrester of claim 1 wherein the webbing has a first end secured to the spool and a second end adapted to be linked to a connector for securing the second end to a weight supporting member of a structure.

5. The fall arrester of claim 4 wherein the connector includes a hook.

6. A fall arrester for reducing injuries of a user when falling comprising a rotatable spool with a length of flexible connecting member wound thereon, the length of flexible connecting member being protracted from and retracted back upon the spool by a rewind spring for reverse winding the webbing upon the spool, the webbing capable of being protracted from the spool and capable of being rewound upon the spool, configured to have the fall arrester function as a spring-loaded tether in an unlock mode of operation, a torsion bar operationally connected to the length of flexible connecting member through the spool to generate a generally constant reaction force on the spool as the torsion bar and spool rotate to absorb kinetic energy of the fall, and further includes a counting mechanism to maintain a reserve amount of length of flexible connecting member on the spool to enable the torsion bar to twist through its operational range without encountering an end of length of flexible connecting member condition, wherein the counting mechanism further is able to initiate a change in the operating mode of the fall arrester to enable the fall arrester to lock when the length of flexible connecting member is protracted at a first dynamic level independent of a length of flexible connecting member that has been protracted from the spool, the change to lock the fall arrester is initiated by an acceleration based sensor to sense a fall event and initiate a lock-up of the fall arrester;

the spool is rotationally supported on a frame; and the length of flexible connecting member; including one of a length of webbing or string or wire; having one end secured to the spool and second end adapted to be linked to a connector for securing the second end to a structure; and wherein the torsion bar has a first end secured to one side of the spool and movable with the spool and a second end connected to a first lock wheel capable of being locked from rotation, the torsion bar capable of being twisted through a given number of turns after the being locked and the connector member and spool are loaded and wherein the counting mechanism prevents further protraction of the length of flexible connecting member on the occurrence of a determinable length of the flexible connecting member having been protracted from the spool while leaving a sufficient amount of the flexible connecting member on the spool to enable the torsion bar to thereafter rotate through a given number of revolutions.

7. The fall arrester according to claim 6 wherein the connector includes a hook.

* * * * *